US005328158A

United States Patent [19]

Lewis et al.

[11] Patent Number: 5,328,158

[45] Date of Patent: Jul. 12, 1994

[54] APPARATUS FOR CONTINUOUS HEAT TREATING ADVANCING CONTINUOUSLY FORMED PIPE IN A RESTRICTED SPACE

[75] Inventors: Philip C. Lewis, Houston; William M. Zernick, Sugar Land, both of Tex.

[73] Assignee: Southwestern Pipe, Inc., Houston, Tex.

[21] Appl. No.: 845,213

[22] Filed: Mar. 3, 1992

[51] Int. Cl.[5] ..... C21D 9/54

[52] U.S. Cl. ..... 266/103; 266/102

[58] Field of Search ..... 266/102, 103; 148/590, 148/596

[56] References Cited

U.S. PATENT DOCUMENTS 2,622,182 12/1952 Forzley et al. ..... 266/103

2,652,478 9/1953 Howard ..... 266/103

FOREIGN PATENT DOCUMENTS 0498472 1/1939 United Kingdom ..... 266/103

*Primary Examiner*—Scott Kastler

*Attorney, Agent, or Firm*—Parks & Associates

[57] ABSTRACT

An apparatus for continuous heat treating advancing continuously formed pipe in a restricted space with minimal deformation of the pipe during the heat treatment comprising a pipe feeder; curved rollers for receiving the pipe and advancing the pipe there around. A heat chamber for housing the curved rollers. A heat source for providing heat to the heat chamber and the pipe. A first deforming element for deforming the pipe into a curve for following the curve rollers and for directing the pipe to transverse across the rollers as the pipe is advanced around the rollers. A second deforming means for receiving and deforming the said pipe as it exists from the rollers into a substantial straight line and a take-up roller for receiving the pipe as it comes through the second deforming means.

9 Claims, 4 Drawing Sheets

APPARATUS FOR CONTINUOUS HEAT TREATING ADVANCING CONTINUOUSLY FORMED PIPE IN A RESTRICTED SPACE

This invention relates to an apparatus for heat treating coiled tubing or continuously formed pipe in a continuous process line located in a confined space while the tubing or pipe is continuously advanced into and out of the heat treating oven. The apparatus of this invention is capable of heat treating rapidly moving continuously formed pipe or coiled tubing in a restricted space while providing the required holding time for the achieving of the time and temperature conditions for transformation of the metal microstructure to its described results while working or bending the pipe or coiled tubing only a minimum number of times.

BACKGROUND OF THE ART

While there are many prior art apparatus used for the continuous heat treating process, they suffered from many short comings such as excessive working or bending of the material in the heat treating process which significantly reduces the useful life of the material heat treated.

While apparatus such as Lorig U.S. Pat. No. 2,587,742, have been utilized in the prior art, this art uses paired reels which are spaced apart to provide an annealing furnace for passing the material through the annealing furnace. The problem with the prior art of this type has been that the multiple reels require multiple bendings of the material over the multiple reels in going from a curved surface to a straight surface many times as the material is passed through the annealing oven because it must pass over two separate rollers going from straight to curved surface each time it passes over the rollers. This furnace provides working of the material which reduces its working life especially if it is a coiled tubing product. The coiled tubing product's life is to some degree a function of the number of times that the tubing is bent or worked, much like the bending of metal wire until it breaks. If in the process of the annealing, working or bending occurs in the pipe, then the overall life expectancy of the tubular pipe is greatly reduced. Thus, art such as Lorig provided a significant amount of working of the material prior to the product being exited from the annealing oven with a corresponding shortening of its useful life.

Other pieces of prior art such as U.S. Pat. No. 3,857,673, issued to Andris attempted to deal with wire and rods to be heat treated by providing a rotatable hollow drum with a plurality of passages extending therethrough. This art provided the passage for communication with the interior of the drum for attempting to provide even heat distribution to the material to be treated. One of the problems associated with Andris, however, was that heat treatment is not evenly applied to the material as large surface areas of the material were laid against the solid part of the drum and were never effectively heated in open air because it stayed against the drum all through its rotational passage until its exit from the drum. Further, the drum surfaces in contact with the material were never allowed to be reheated by re-exposure to the heated air during the materials heat treatment and thus provided uneven heat treatment of the material.

Further patents such as U.S. Pat. No. 1,243,443 issued to Pierce which have attempted to provide more heated air exposure by using loops or coils, and minimum contact of the material have proved unsuccessful. The reason Pierce was not successful was that the heat treating support structure did not provide the coils or loops with means to be controlled as they are slid sideways down the hangar or support structure. As this art was more of a batch process than a high speed heat treat furnace for continuously formed product, control of the loops or coils was not so critical in Pierce. It was, however, necessary in this prior art patent to provide for an upward curve at the free end of the hangar so as to furnish a stop against the natural sliding of the coils by gravity off the hangar. Thus, the application of the patent of Pierce would not have been appropriate for high volume, high velocity continuously formed tubing or pipe. Further, this patent really relates to heating material prior to providing it for forging of the material.

Also, many of the prior art heat treat furnaces required specialized machined surfaces to provide helical cut grooves in the cylinders for advancing the material therethrough. In such helically cut cylinders the advancing was achieved, but because of the helical surfaces needed to control the material's advancement, uneven heat treatment of the material occurred due to the excessive surface engagement of the helical surfaces and the material which prevented the lack of exposure to the heated air. Further, with machined helically cut surfaces it required a new set of surfaces with each new heat treatment time and temperature requirement which was very expensive in time and money.

There have been many prior art attempts to achieve a proper heat treating of high velocity, advancing materials located in a confined space without excessive working of the materials. These prior art attempts have been very expensive and have left the material with a reduced life and unevenly heat treated materials.

OBJECTS

It is the object of this invention to provide for continuous heat treating of advancing continuous formed pipe located in a restricted area with minimal deformation of the pipe during the heat treatment.

It is the further object of this invention to provide the heat treatment of this invention by only inducing two bends in the material. One bend to start the material into the furnace and the second bend occurring at the time the material is discharged from the furnace back into straight line of material.

It is the further object of this invention to provide a means of moving the material across the surface of the heat treat furnace as the material is passed through the furnace in a helical fashion without providing helicaly cut grooves which require extensive machining and accuracy for accurately controlling the movement of the material through the furnace.

It is the further object of this invention to provide a heat treating furnace which provides minimal contact of the material and the supporting surfaces in the furnace to provide uniform heating of the material to be heat treated.

It is the further object of this invention to provide a minimal point of contact which is tangential and constantly changing for providing a better heat transfer and less conductance away from the material for eliminating cold spots.

It is the further object of this invention to provide a means for exposing the material extensively to the heated air, except for the minimal tangential contact with supporting structures in the heat treat oven.

It is further the object of this invention to provide rotation of the material over a series of rollers spaced apart in a circle within the furnace, with the circle of rollers having a diameter sufficient that only a minimal amount of deformation occurs after the initial bending of the material for setting the material in the curvature of the series of circular rollers spaced apart within the furnace.

It is the further object of this invention to provide minimal contact between the material and the rollers.

It is yet another object for the rollers to be rotated away from contact with the advancing surface of the material for the rollers to be re-heated, such that at the time of renewed contact with the material the rollers are heated to a proper temperature, which therefore provides a more even temperature and more even heating of the material. As the material at any one point in time is only in contact with the rollers for a short period of time and the heated air in the furnace is circulated about both the rollers and the material, thus when the material and rollers are not engaged with each other the heated air is reheating those surfaces such that when the material and rollers are in contact again the material will not have heat conducted away from the material into the rollers.

It is the further object of this invention to provide a heat treating apparatus which does not have expensively machined helical grooves cut into a roller surface which not only drives up the cost of rollers but requires that a roller can only be used for one rate of speed and holding time.

It is the object of this invention to provide a heat treat roller which provides no helically machined grooves but provides offset retaining members on the rollers and which provides for frictional engagement of the material to continue its rotation through the furnace.

Further, it is the object to provide adjustment to the offset retaining members within the furnace by adjusting the position of the rollers relative to each other therefore allowing the furnace to heat treat different types of continuously formed pipe at any given rates or holding times without requiring a changing of the rollers and putting in a specially machined helical grooved surface.

Further objects and advantages of this invention will become apparent from referring to the drawings and detailed specifications.

Figure 1:
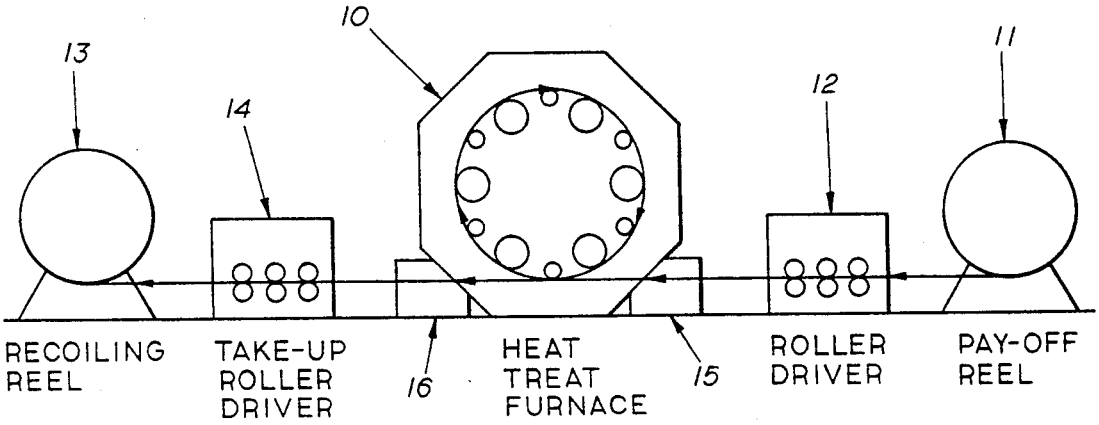
FIG. 1 is a diagrammatic view of the heat treat furnace of this invention.

The heat treat furnace 10 for continuous heat treating of the advancing continuous formed pipe in a restricted space with minimal deformation of the pipe during the heat treatment is shown generally in FIG. 1. Also shown in FIG. 1 is the pay off wheel 11 which provides the continuously formed pipe in this embodiment shown. Further, in this embodiment there is connected a roller driver 12 which is used to pull the pipe off the pay off reel 11 and drive the pipe into the heat treat furnace 10 and in this embodiment imparts a positive feed pressure to the pipe as it is fed into the heat treat furnace 10.

Further shown in this FIG. 1 is the take-up roller driver 14 for feeding the pipe off the heat treat furnace 10. Also shown in this figure is the recoiling reel 13 for receiving the pipe from the heat treat furnace 10 as it is played out of the heat treat furnace 10 and fed through the take-up roller driver 14.

Figure 2:
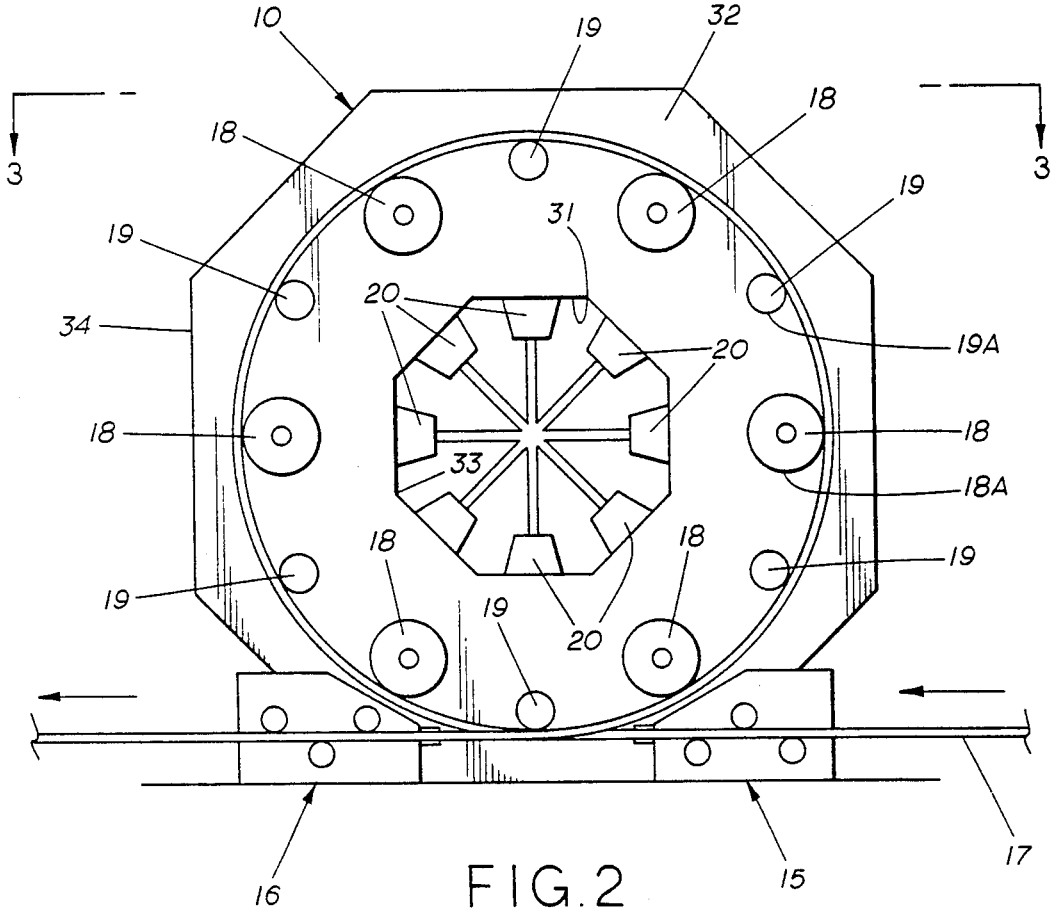
FIG. 2 is a cross-section taken through the heat treat furnace of FIG. 1 showing an internal view of the furnace itself.

Referring now to FIG. 2 a first deforming area 15 is generally shown approximate to the heat treat furnace 10. Also shown in FIG. 2 is a second deforming area 16 shown generally also proximate to the heat treat furnace 10 but on the take-up roller driver 14 side of the heat treat furnace 10. From FIG. 2 it can be seen that the pipe 17 is fed into the first deforming area 15 and then into the heat treat furnace 10 for the continuous heat treating of the advancing pipe 17. Once the pipe has been fully heat treated in the furnace 10 it is discharged through the second deforming area 16 and taken up by the take-up roller driver 14 for feeding to the recoiling reel 13.

The heat treat furnace 10 shown generally as 10 in FIG. 2 is composed of power rollers 18 and idler rollers 19 arranged in a circle and in a spaced apart configuration for receiving the pipe material 17 into the furnace and for advancing the pipe about the furnace 10.

The pipe 17 is advanced into and about the furnace 10 by the series of power rollers 18 and idler rollers 19 which are spaced apart in a circle within the heat treat furnace 10. The power rollers 18 are in a circle and are set for tangential contact with the pipe 17 for driving the pipe by imparting the driving power to the pipe 17 to continue its rotation through the heat treat furnace 10. The series of idler rollers 19 are also placed in a circle in a spaced apart and circular arrangement within the heat chamber for providing tangential contact between the pipe 17 and the idler rollers 19 and for supporting the pipe 17 as it is passed through the heat treat chamber 10. These idler rollers 19 may be arranged between the power rollers 18 for providing the pipe 17 alternate support and power to drive it.

It should be understood that by the idler rollers 19 and power rollers 18 being in constant motion and the pipe 17 being in constant motion there is only a minimal amount of contact both in terms of surface area 18A and 19A of power rollers 18 and idler rollers 19 and the pipe 17 and in terms of time of contact between the pipe 17, idler rollers 19 and the power rollers 18. Also it will be appreciated that the point of contact between the pipe 17 and the idler rollers 19 and power rollers 18 is constantly changing as the pipe 17 moves past the idler rollers 19 and the power rollers 18 and the rollers 18 and 19 are rotated. Thus it will be appreciated that the minimal amount of surface contact is partially achieved by the pipe 17 being only in tangential contact with the power roller 18 and the idler rollers 19 at all times that the pipe 17 is being passed through the heat treat furnace 10 for the heat treatment and that the tangential contact surface 19A and 18A are constantly changing. It should be appreciated that in some embodiments that the number of power rollers 18 and idler rollers 19 will vary and in some cases the idler rollers 19 may not be used.

These idler rollers 19 and power rollers 18 of the heat treat furnace 10 are located within a housing which in one embodiment is shaped into a octagonal donut shaped housing 32. Located within the hole 31 of this octagonal donut shaped housing 32 are heating elements 20 for providing heat to the heat treat furnace 10. These heating elements 20 are located along the inside surface 33 of the octagonal donut shaped housing 32 of the heat treating furnace 10 and are facing toward the outside surface 34 of the octagonal donut shaped housing 32 of the heat treat furnace 10.

It will be appreciated that by locating the heating elements 20 on the inside surface 33 of the octagonal donut shaped housing 32 and directing them outwardly toward outside surface 34 of the octagonal donut shaped housing 32 that there is maximum utilization of heat distribution and further that the heating elements 20 are efficiently arranged relative to the idler rollers 19 and the power rollers 18 to provide heating of those moving surface areas 18A and 19A when they are not in contact with the pipe 17. It will be appreciated that this constant reheating of these surfaces provides more even heat treatment and prevents the pipe 17 from coming in contact with cold spots during the heat treatment process. Further, it should be understood that the spaces between the idler rollers 19 and the power rollers 18 arranged in the circular configuration within the heat treat furnace 10 will provide sufficient space between rollers, new surfaces and continual heating of those surfaces to prevent hot cold spots from developing on the pipe 17 and on the power rollers 18 or idler rollers 19. Leaving as much exposure to the heated air generated by the heating elements 20 is important and is possible while providing a minimal contact to the pipe 17 as it is the advanced through the heat treat furnace 10, because of this configuration of rollers which provides for consistent and controlled heat treating of the pipe 17. Also it will be appreciated that by having the octagonal donut shaped housing 32 the heat treat furnace 10 retains as much of the heat as possible for more efficient operation.

Figure 7:
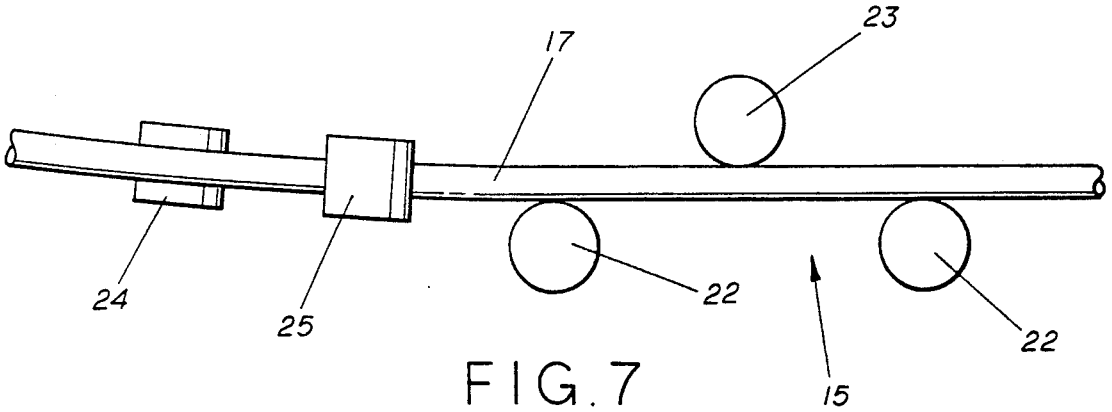
FIG. 7 is a side view of the initial rollers used to set the curvature of the pipe material and the helical rollers used to set the helical curvature of the pipe material.
Figure 8:
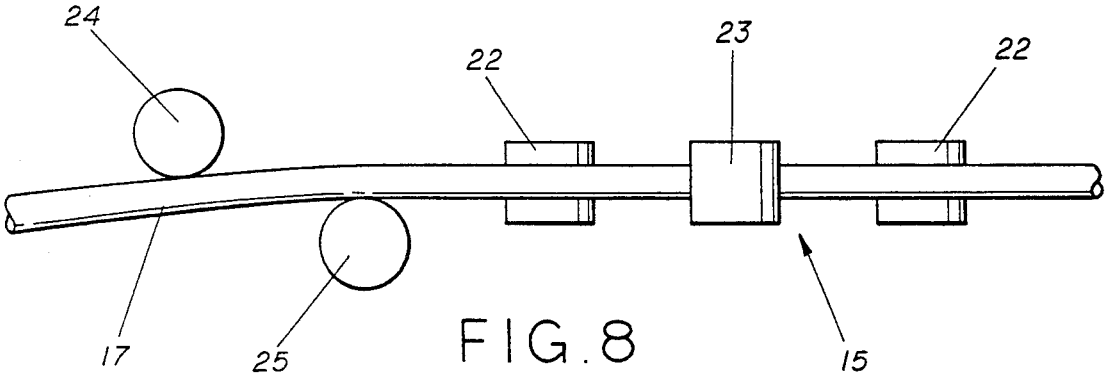
FIG. 8 is a top view of the initial rollers used to set the curvature of the pipe material and the helical rollers used to set the helical curvature of the pipe material.

Referring now to FIG. 7 and FIG. 8 which would show more details of the first deforming area 15 and second deforming area 16, it will be seen that the first and second deforming areas are, at least in this embodiment, composed of a series of rollers placed in opposing arrangement.

Referring now to the first deforming area 15 of this embodiment as show in FIG. 7 it is composed of at least a first pair of spaced apart rollers 22 and at least one curved forming roller 23 spaced above the first pair of spaced apart rollers 22 and between the first pair of rollers 22. The first curved forming roller 23 is adjustably mounted above the first pair of spaced apart rollers 22 for up and down adjustment sufficient for deforming and advancing the continuously formed pipe 17 into a curve sufficient for following the curve of the circle formed by the arrangement of power rollers 18 or idler rollers 19 within the heat treat furnace 10. Also located within said first deforming area 15 and approximately the first pair of spaced apart rollers 22 and the one curved forming roller 23 is located a first helix forming pair of rollers 24 and 25. The helix forming roller 25 is relatively fixed mounted and the helix roller 24 is adjustably mounted for providing bending pressure to induce an angle in said pipe 17 sufficient in combination with the curve formed in the pipe 17 to create a helix for traversing the pipe 17 around and across the power rollers 18 and idler rollers 19 for providing a means for moving the pipe through said heat treating furnace 10 both in a circular and in a axial direction for passing the pipe 17 through the furnace for heat treat.

Figure 9:
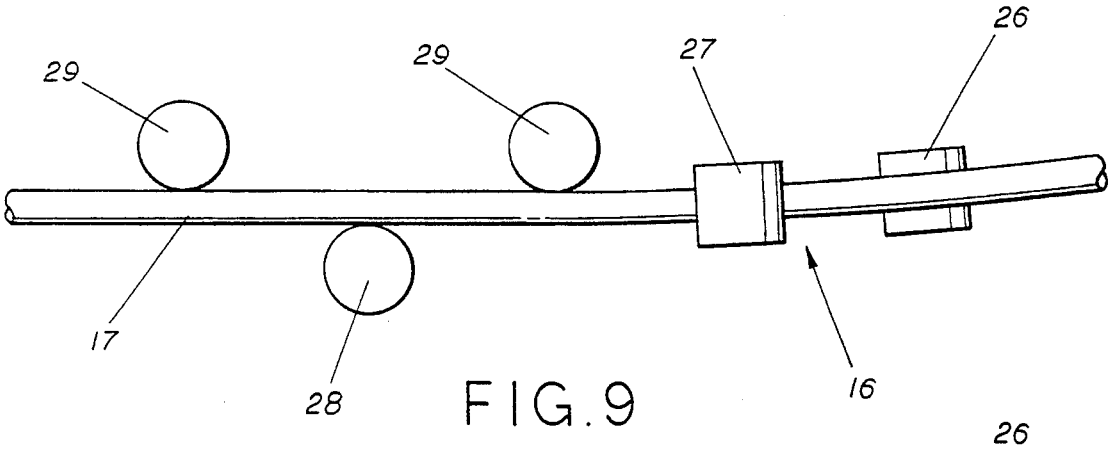
FIG. 9 is a side view of the exit rollers used to remove the curvature of the pipe material and the helical removing rollers used to remove the curvature of the pipe material as its is exited from the heat treatment furnace.
Figure 10:
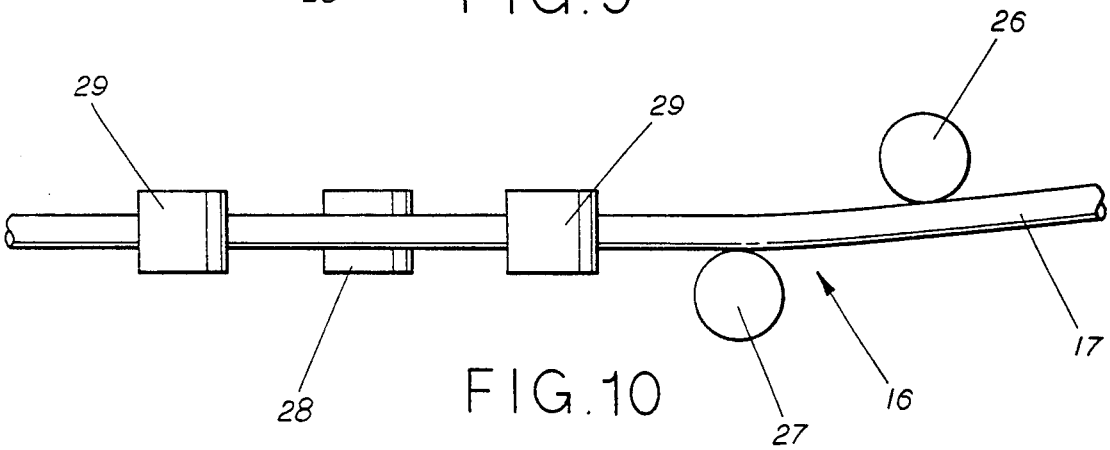
FIG. 10 is a top view of the top exit rollers used to remove the curvature of the pipe material and the helical removing rollers used to remove the curvature of the pipe material as it is exited from the heat treatment furnace.

Referring now to the second deforming area shown in FIGS. 9 and 10 there is provided a pair of helix straightening rollers 26 and 27. The helix straightening roller 27 is relatively fixed mounted and helix straightening roller 26 is mounted for adjustment to impart a straightening of the pipe 17 by the helix straightening roller 26 as the pair of helix rollers 26 and 27 receive the pipe 17 between the pair of helix straightening rollers 26 and 27 as it advances.

Also located proximate the helix straightening rollers 26 and 27, as shown in FIG. 9 and 10, are a spaced apart pair of curved straightening rollers 29 and first curved straightening roller 28. The first curved straightening roller 28 is located between the spaced apart pair of curved straightening rollers 29 for imparting a straightening deformation sufficient for deforming the advancing pipe into a straight line and for advancing the pipe to the take-up roller driver 14.

It will be appreciated by those skilled in the art that from the descriptions of the deforming means described that there is a minimal amount of deforming of the pipe 17 as there is only deforming of the pipe sufficient to create a curve and axial bend in the pipe 17 to conform with the circular arrangement of the power rollers 18 and idler rollers 19 and to move the pipe 17 across and about the power rollers 18 and idler rollers 19. After the curve and axial deformation occurs in the pipe 17 there is no more deformation of the pipe until such time as pipe 17 exits the heat treat furnace 10 and is restraightened through the straightening rollers 26, 27, 28, and 29. Thus, a minimal amount of deformation occurs in the pipe as it is passed through the heat treat furnace 10 because once the deformation is set it is fully heat treated before any other deformation occurs in the pipe. The arrangement of the spaced apart rollers both idler rollers 19 and power rollers 18 are in such arrangement that there is no further deformation of the pipe 17, once the pipe is on the power rollers 18 and idler rollers 19. As these rollers are arranged in a relatively large circle there is a gentle curve and the pipe only makes tangential contact with the power rollers 18 and idler rollers 19.

Figure 6:
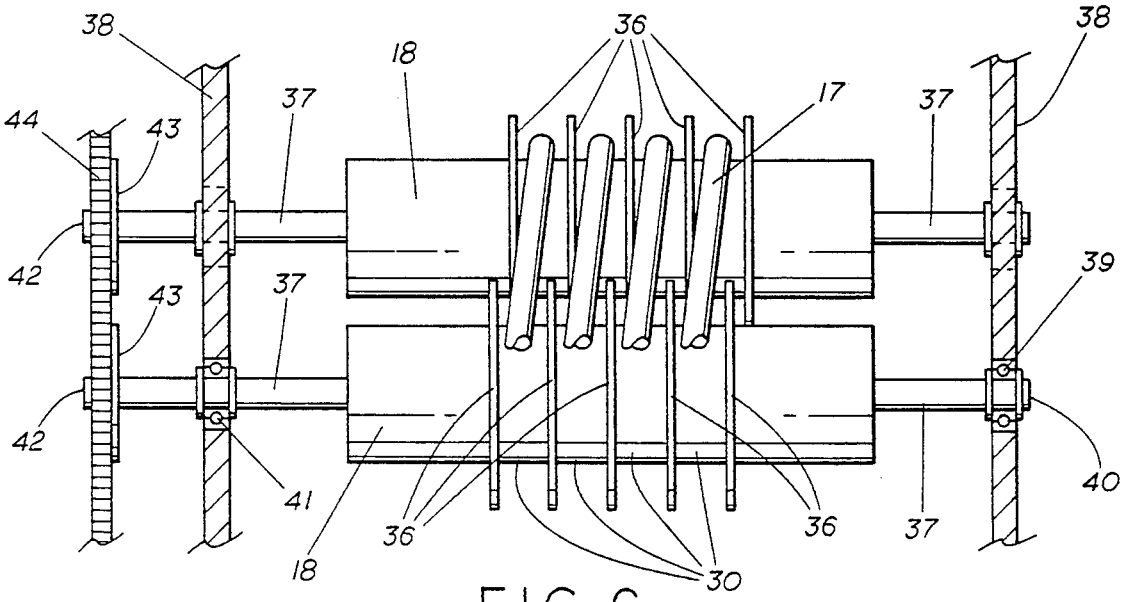
FIG. 6 is a cross-sectional view of a roller and the connection of the roller driver to the roller.

Further referring to FIG. 6 which shows detail of at least one embodiment of a power roller 18, it can be seen that a series of spaces 30 are formed from circular guide disks 36 which are provided on the power roller 18 shown in this embodiment. These circular guide disks 36 may be adjusted or removed from the power rollers 18 or added to the power rollers 18 or to the idler rollers 19 as needed to aid in the guiding of the pipe 17 through the heat treat furnace 10. FIG. 6 also shows that the power rollers 18 are mounted on an axial 37 which is mounted in the side walls 38 of the octagonal donut shaped housing 32. The axial 37 is mounted on a terminal bering 39 on one end 40 and a pass through bering 41 on the other end 42 which allows the axial 37 to be connected to a sprocket 43 which is in turn connected to a drive chain 44 for connection to a driving means not shown in FIG. 6 for driving the power rollers 18.

Figure 4:
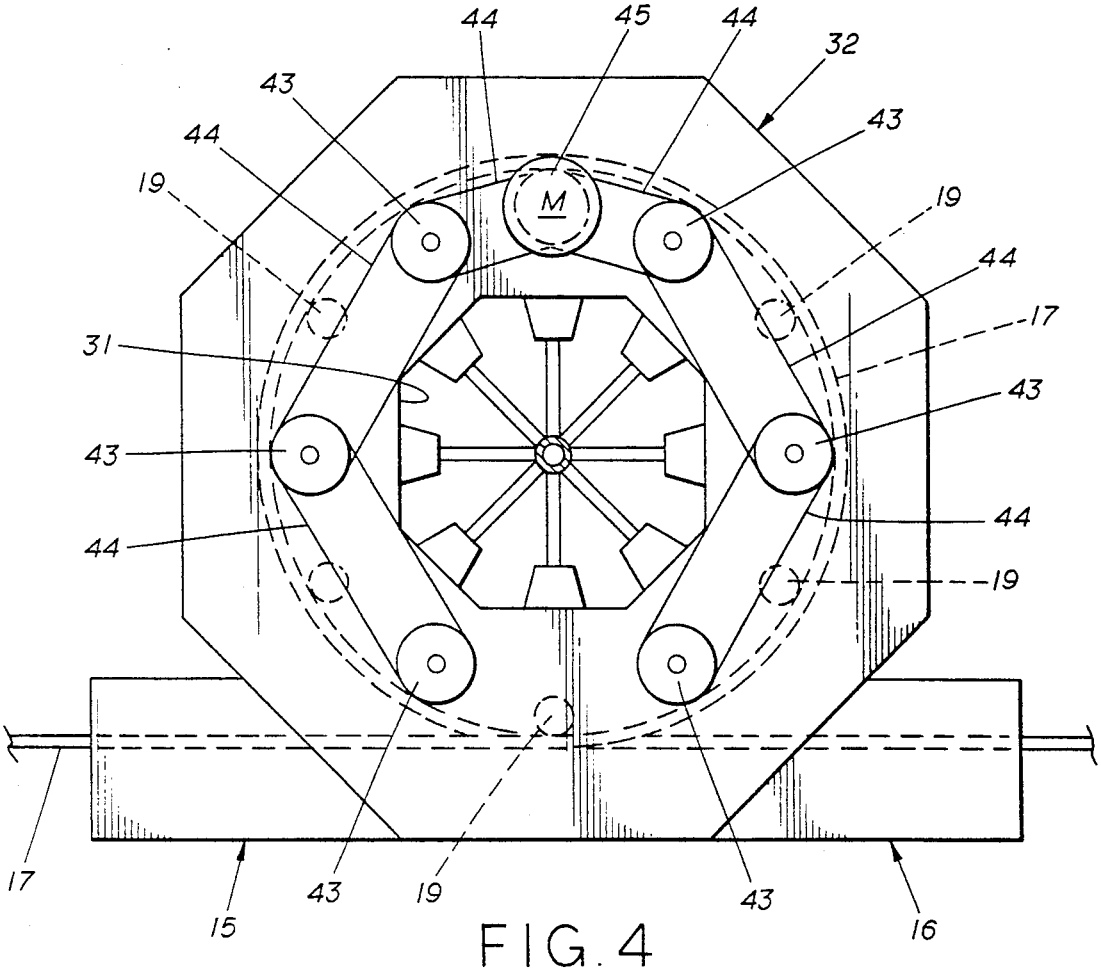
FIG. 4 is a view of the driving system which drives the powered rollers of the heat treat furnace.
Figure 5:
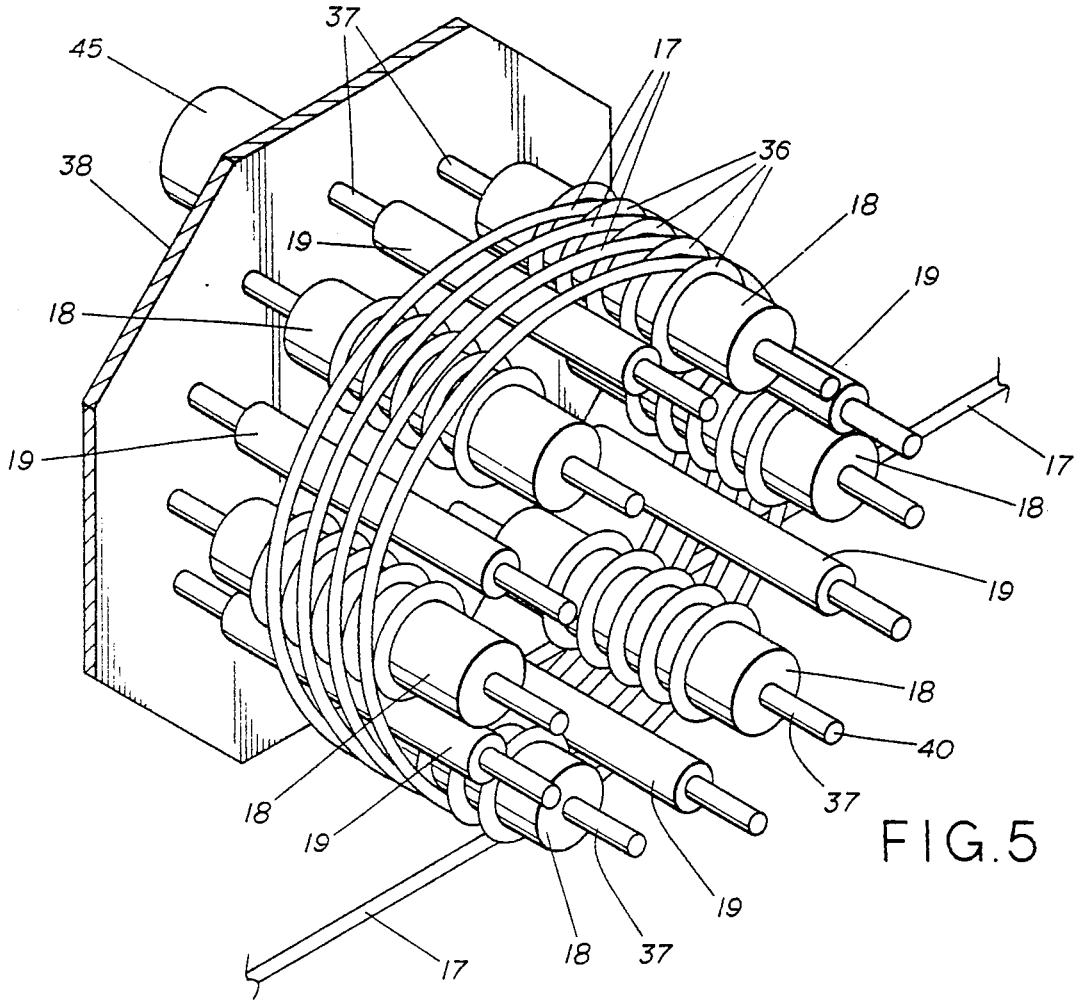
FIG. 5 is a diagrammatic view of the material being passed through the rollers.

In FIG. 4 it can be seen how these power rollers 18 may in one embodiment be interconnected to one driving means 45 by means of a series of sprockets 43 and drive chains 44 for driving the power rollers 18 to keep the pipe 17 moving through the heat treat furnace 10.

Figure 3:
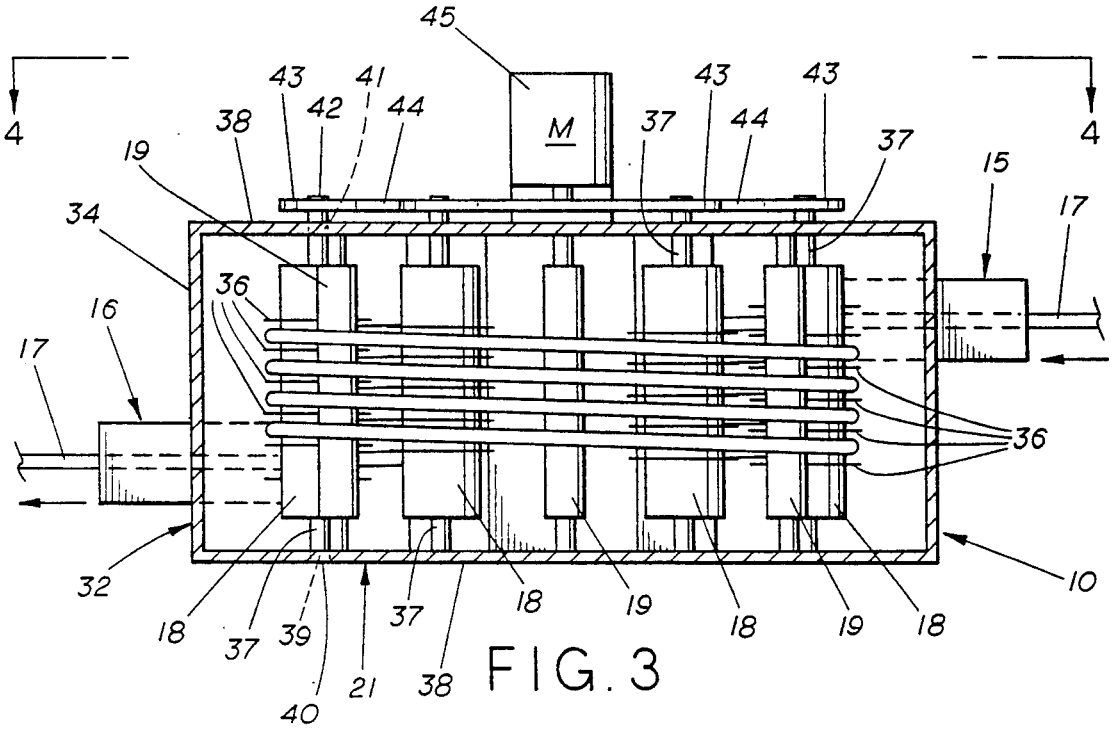
FIG. 3 is a cross-section of the top view of the furnace showing the material as it is passed through the heat treat furnace.

In FIG. 3 it will be seen that the power rollers 18 mounted in the octogonal donut shaped housing 32 are positioned at differing positions on their respective axials 37 which in turn puts the circular guide disks 36 slightly out of alignment in going from one set of power rollers 18 and circular guide disks 36 to the next. This misalignment however allows the pipe 17 which has a helical bend in it to move from one power roller 18 to the next as it passes through the heat treat furnace 10 and at the same time move across the power rollers 18 and idler rollers 19 from one side to the other, as shown in FIG. 3, as the pipe 17 is rotated about inside the heat treat furnace 10 for continuously heat treating the advancing continuously formed pipe 17 in a restricted space and having minimal deformation of the pipe 17.

It will be appreciated by those skilled in the art that circular guide disks 36 can be adjusted to provide a slight biasing of the pipe 17 as it is rotated through the power rollers 18 and idler rollers 19 if they have circular guide disks 36. This biasing effect can be adjusted to impart more or less a pulling power on and/or guidance of the pipe 17 as needed in different applications. This adjustment can be made in one embodiment by moving the power rollers 18 and/or idler rollers 19 either left or right in its axial mounting as needed. Also, as these adjustments are only positioning adjustments these rollers do not generally have to be replaced to run different types of pipe which save both time and money.

Further, other embodiments can be used without departing from the scope of this invention.

I claim:

1. An apparatus for continuously heat treating advancing continuously formed pipe in a restricted space and for minimal deformation of said pipe during said heat treatment comprising;

a pipe feeding means;

a series of powered rollers spaced apart in a circle of sufficient size within said heat chamber for tangential and non-deforming contact with said pipe for driving said pipe through said heat chamber for heat treatment;

a heat chamber for housing said series of powered rollers;

a heater means for providing heat to said heat chamber and said pipe;

a first deforming means for deforming said pipe just sufficiently into a curve for following said series of powered rollers upon said pipes advancing into said heat chamber and for directing said pipe to transverse across said rollers as said pipe is advanced around said rollers;

an second deforming means for receiving and deforming said pipe just sufficiently as it exits from said series of powered rollers into a substantially straight line; and a take up means for receiving said pipe as it comes from said exit second deforming means.

2. An apparatus for continuously heat treating advancing continuously formed pipe in a restricted space and for minimal deformation of said pipe during said heat treatment as in claim 1 which further comprises;

a series of idler rollers spaced apart in a circle of sufficient size and located between said powered rollers within said heat chamber for tangential and non-deforming contact with said pipe and for support of said pipe as it passes through said heat chamber for heat treatment.

3. An apparatus for continuously heat treating advancing continuously formed pipe in a restricted space and for minimal deformation of said pipe during said heat treatment as in claim 2 wherein said series of powered rollers further comprises;

a series of spacer means on each powered roller and said spacer means are arranged in offsetting alignment from one power roller to the next for maintaining said pipe in helical shape as said pipe is passed across said rollers.

4. An apparatus for continuously heat treating advancing continuously formed pipe in a restricted space and for minimal deformation of said pipe during said heat treatment as in claim 3 wherein said series of spacer means on each powered roller are arranged in offsetting alignment a distance sufficient to engage said pipe from slippage from one power roller to the next as said pipe is passed across said rollers.

5. An apparatus for continuously heat treating advancing continuously formed pipe in a restricted space and for minimal deformation of said pipe during said heat treatment as in claim 4 wherein said series of powered rollers further comprises;

a series of spacer means on each idler roller and said spacer means are arranged in offsetting alignment from one idler roller to the next for maintaining said pipe in helical shape as said pipe is passed across said rollers.

6. An apparatus for continuously heat treating advancing continuously formed pipe in a restricted space and for minimal deformation of said pipe during said heat treatment as in claim 5 wherein said series of spacer means on each idler roller and said spacer means are arranged in offsetting alignment a distance sufficient to engage said pipe from slippage from one idler roller to the next as said pipe is passed across said rollers.

7. An apparatus for continuously heat treating advancing continuously formed pipe in a restricted space and for minimal deformation of said pipe during said heat treatment as in claim 6 wherein said first deforming means comprises;

at least a first pair of roller means spaced apart and adjustable mounted for receiving said advancing continuously formed pipe;

one curve forming roller means spaced midway between said first pair of rollers spaced apart and adjustable mounted above said pair of rollers spaced apart for up and down adjustments sufficient for deforming said advancing continuously formed pipe into a curve for following said curved roller means; and a first helix forming roller means positioned adjacent said at least a pair of roller means and adjustable mounted for adjustments sufficient for deforming said advancing continuously formed pipe to a helical angle sufficient to traverse across said rollers means as said pipe is moved around said roller means.

8. An apparatus for continuously heat treating advancing continuously formed pipe in a restricted space and for minimal deformation of said pipe during said heat treatment as in claim 7 wherein said second deformation means comprises;

a helix straightening roller means adjacent said curved roller means for receiving said advancing continuously formed pipe from said curved roller means for deforming said advancing continuously formed pipe with said helical angle to a straight line;

at least a second pair of roller means spaced apart and adjustable mounted for receiving said advancing continuously formed pipe; and a second curve straightening roller means spaced midway between said at least pair of rollers spaced apart and adjustable mounted below said pair of rollers spaced apart for up and down adjustments sufficient for deforming said advancing continuously formed pipe into a straight line for being received by said take up means

9. An apparatus for continuously heat treating advancing continuously formed pipe in a restricted space and for minimal deformation of said pipe during said heat treatment as in claim 8 wherein said heat chamber for housing said curved roller means comprises;

a chamber formed into a donut octagonal shaped closed chamber for housing said curved roller means therein and said heater means are position equal distant from each other and located in side said octagonal donut shaped chamber and facing outward toward said curved roller means in said donut shaped closed chamber.

* * * * *